US005509152A

United States Patent [19]

Kippes

[11] Patent Number: 5,509,152

[45] Date of Patent: Apr. 23, 1996

[54] TRANSFER AID

[76] Inventor: Arlin J. Kippes, 2800 Maupin La., Topeka, Kans. 66614

[21] Appl. No.: 281,180

[22] Filed: Jul. 27, 1994

Related U.S. Application Data

[63] Continuation-in-part of Ser. No. 191,488, Feb. 4, 1994, Pat. No. 5,347,666.

[51] Int. Cl.[6] ..... A61G 7/10

[52] U.S. Cl. ..... 5/81.1; 5/662; 135/67

[58] Field of Search ..... 5/503.1, 658, 662, 5/81.1; 135/67; 297/5

[56] References Cited

U.S. PATENT DOCUMENTS

| | | | |
|---|---|---|---|
| 3,176,322 | 4/1965 | Mulcahy . | |
| 3,310,817 | 3/1967 | Harding | 5/662 |
| 3,553,746 | 1/1971 | Seiger . | |
| 3,591,874 | 7/1971 | O'Kennedy et al. . | |
| 3,668,723 | 6/1972 | Bratton . | |
| 3,739,793 | 6/1973 | Wilson | 5/503.1 |
| 4,251,105 | 2/1981 | Barker . | |
| 4,640,301 | 2/1987 | Battison, Sr. et al. . | |
| 4,922,560 | 5/1990 | Skibinski . | |
| 4,964,182 | 10/1990 | Schmerler . | |
| 5,188,139 | 2/1993 | Garelick . | |
| 5,189,741 | 3/1993 | Beardmore | 5/81.1 X |
| 5,226,439 | 7/1993 | O'Keeffe et al. . | |
| 5,257,425 | 11/1993 | Shinabarger . | |
| 5,275,187 | 1/1994 | Davis . | |
| 5,305,773 | 4/1994 | Browning | 135/67 |
| 5,347,666 | 9/1994 | Kippes | 5/81.1 |
| 5,449,013 | 9/1995 | Landers | 135/67 |

FOREIGN PATENT DOCUMENTS

| | | |
|---|---|---|
| 2274274 | 1/1976 | France . |

*Primary Examiner*—Michael F. Trettel
*Attorney, Agent, or Firm*—Richard C. Litman

[57] ABSTRACT

A transfer aid for assisting people with restricted mobility to rise from a seated position into a standing position. It is a lightweight, portable device having a portion for the user to grasp positioned directly in front of the user. Two supports are each located on either side of the portion to be grasped, and are each rotatable with respect to this portion. This adds flexibility to the device and permits it to be used in a plurality of situations. The transfer aid is easily transported by tilting it so that it rests upon wheels, or tilting it so that it rests upon plastic caps.

15 Claims, 10 Drawing Sheets

FIG. 1
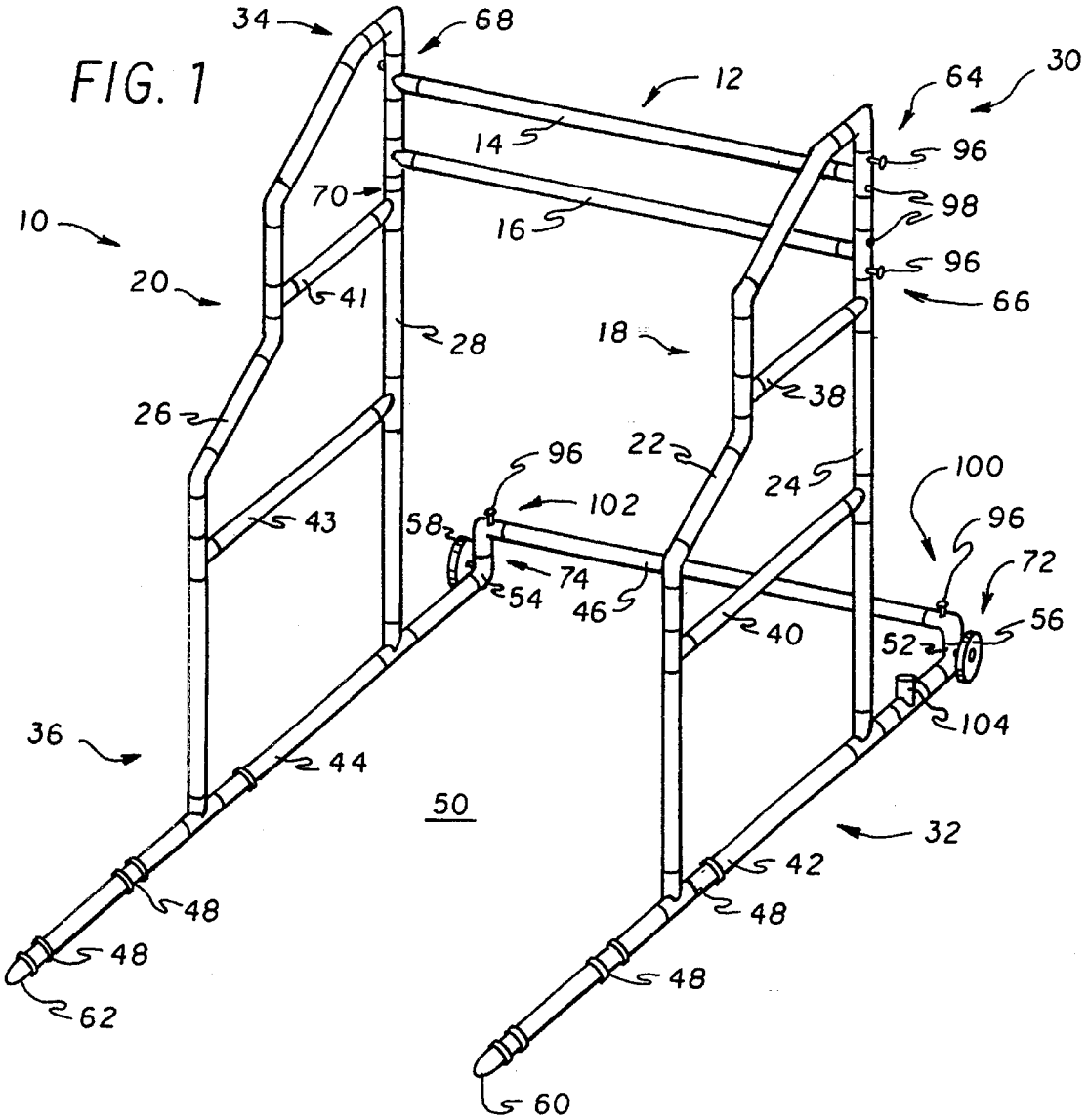
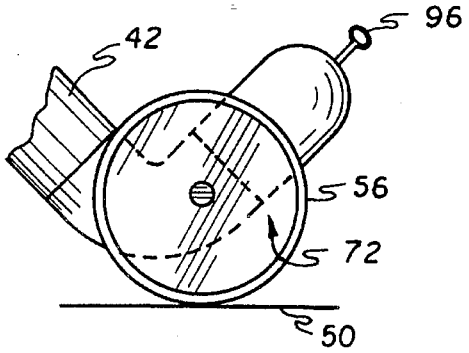
FIG. 3
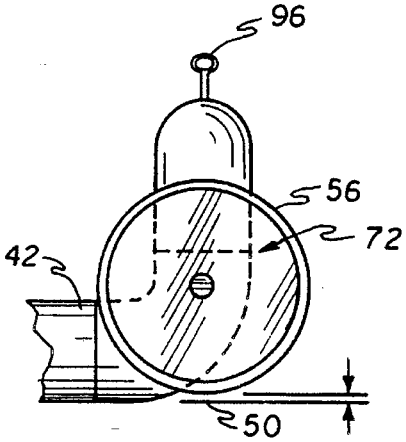
FIG. 2

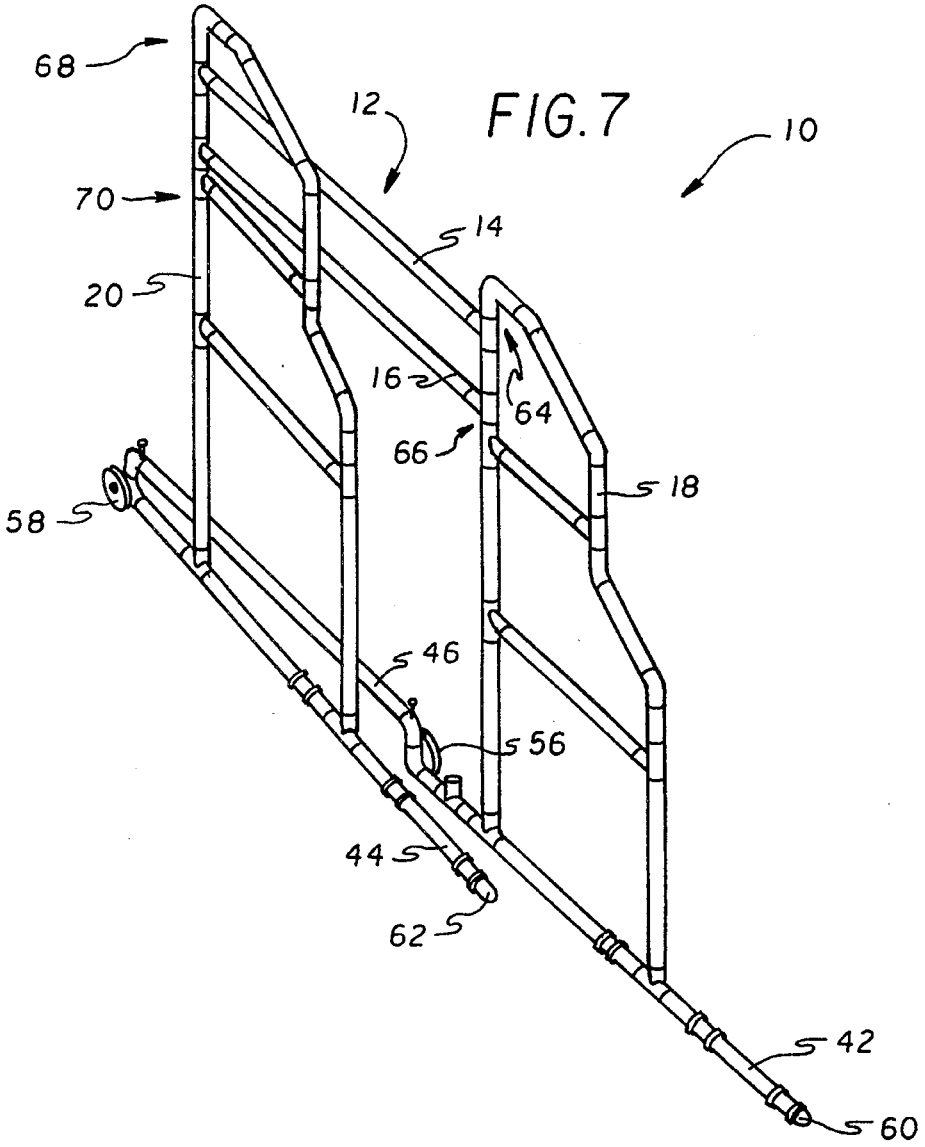
FIG. 7
FIG. 8A
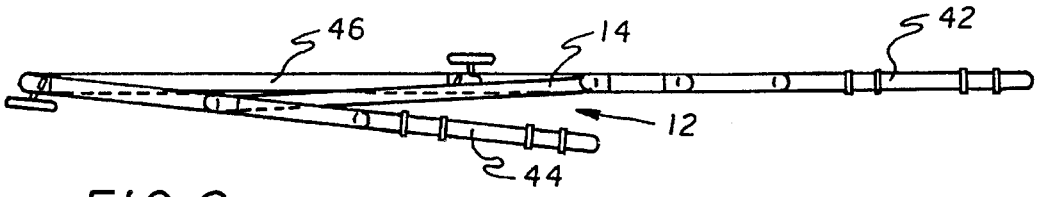
FIG. 8B
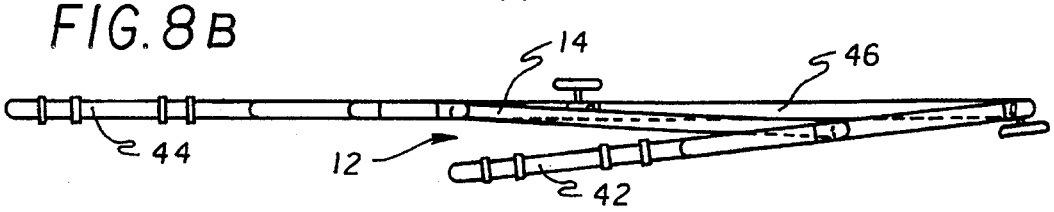

FIG.9
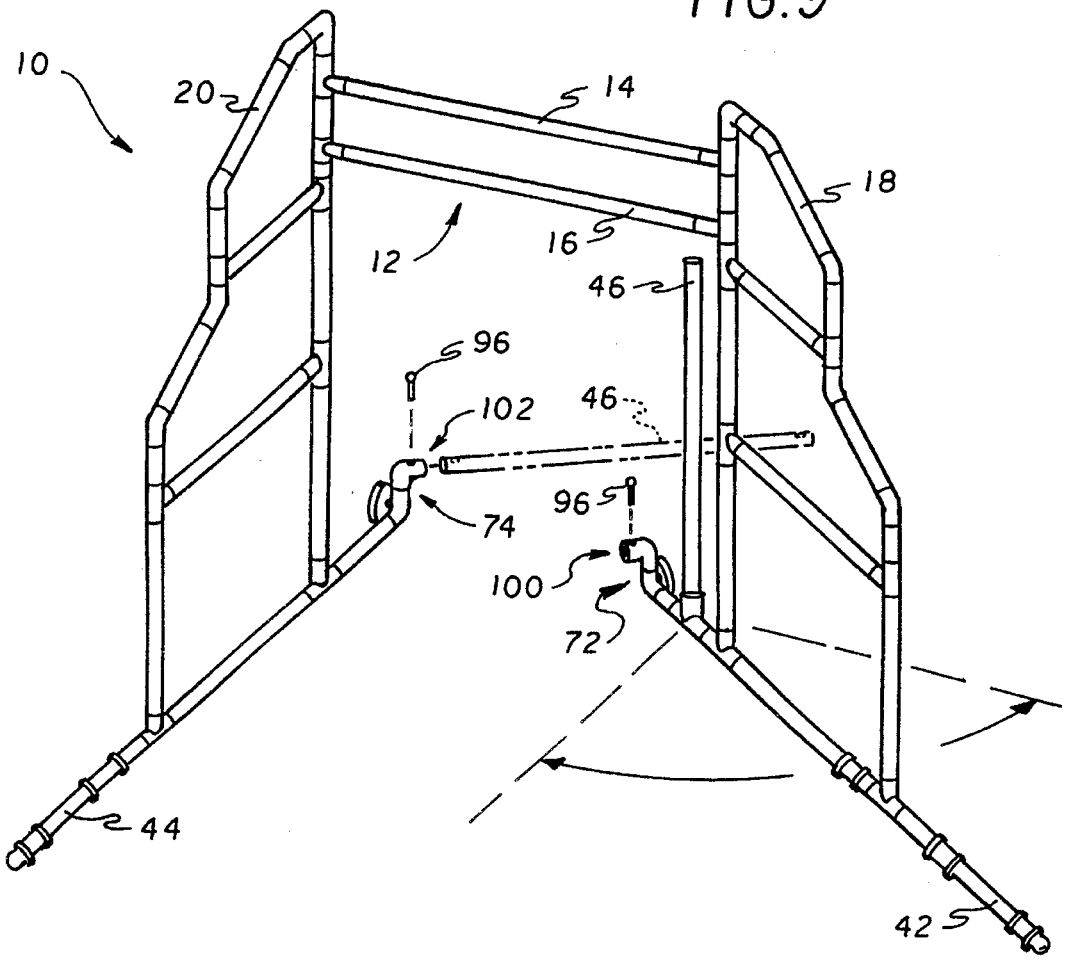
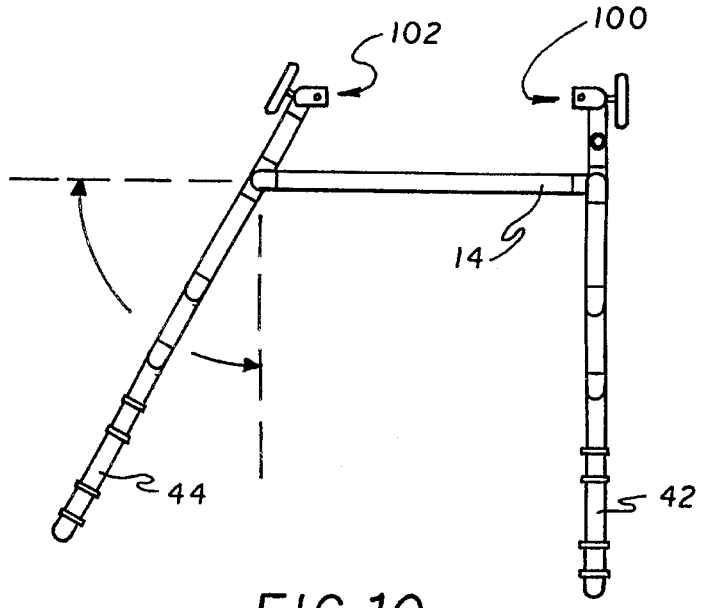
FIG.10

FIG. 14
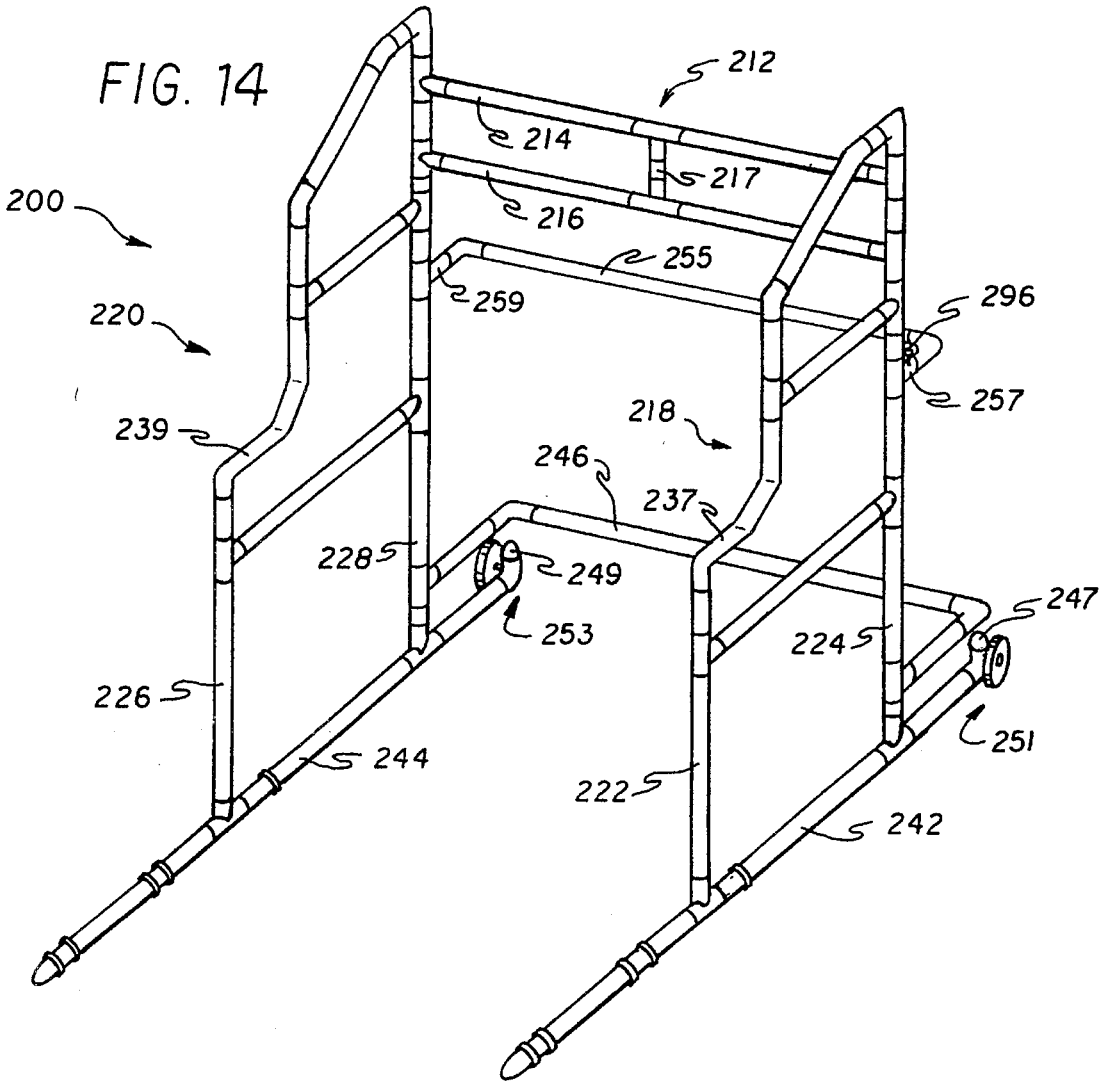
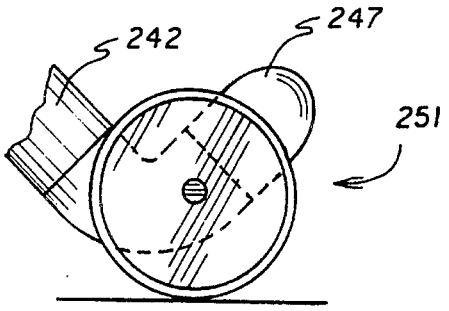
FIG. 16
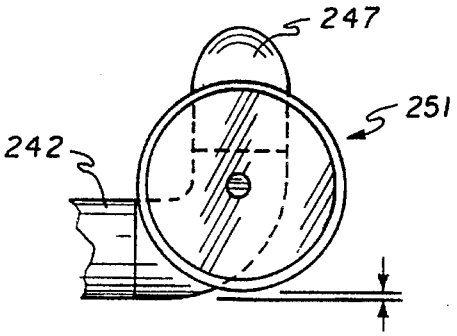
FIG. 15

200
214
212
216
218

296
255
237
257
224
222
246
247
251
242

FIG. 22
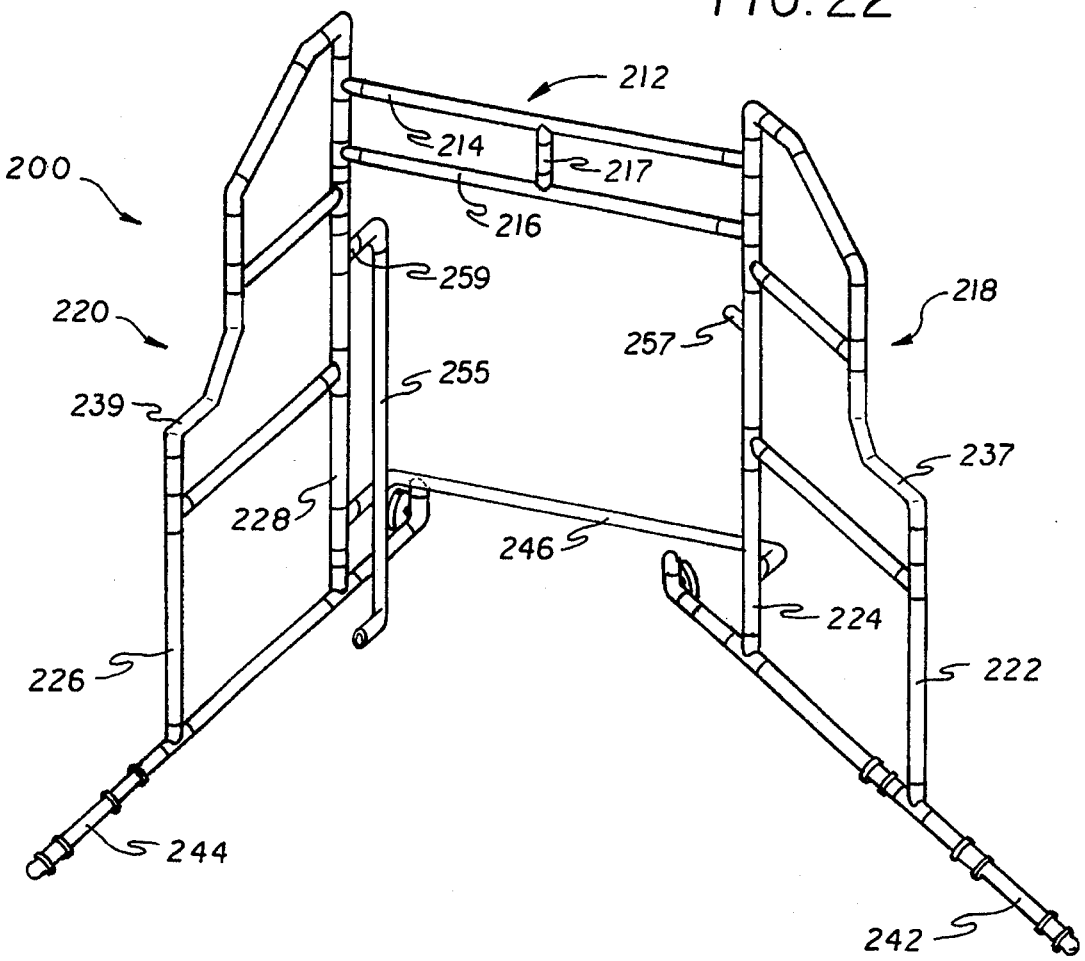
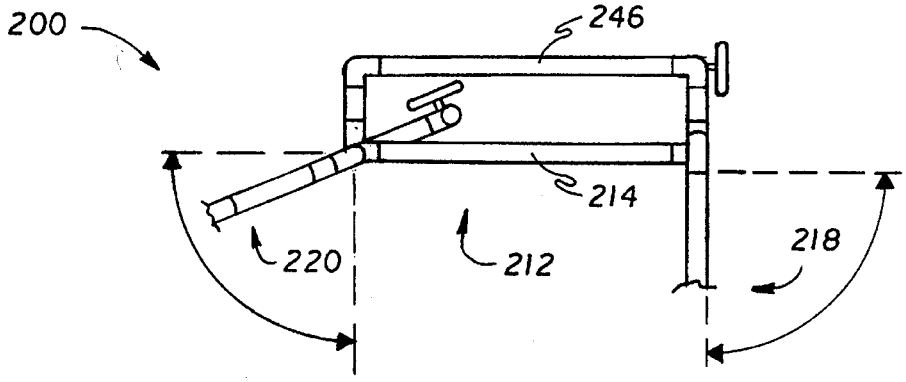
FIG. 23

TRANSFER AID

CROSS-REFERENCE TO RELATED APPLICATIONS

This Application is a Continuation-In-Part of U.S. Ser. No. 08/191,488, filed Feb. 4, 1994, now U.S. Pat. No. 5,347,666.

BACKGROUND OF THE INVENTION

1. Field of the Invention

The present invention relates to a transfer aid designed for assisting a user to rise from a seated position. More particularly, the invention relates to a portable, lightweight transfer aid, capable of being used in conjunction with a standard walker or similar device.

2. Description of the Prior Art

People having a limited mobility often need assistance when rising from a seated position to a standing position. However, helping such a person carry out this activity is commonly too great a task for a single caregiver to undertake. The caregiver may not possess sufficient strength for effective assistance, and if he or she does posses such strength, the awkward act of lifting a person of limited mobility may result in injury to either the patient or caregiver, or both.

Devices for assisting persons to rise to a standing position, without the assistance of a caregiver, are known in the prior art. Common to these devices is a supporting mechanism for the user to grasp and exert force against in order to facilitate movement into a standing position. One type of supporting mechanism includes a plurality of support bars positioned in front of the user, where the bars can easily be grasped. This type of mechanism is seen in U.S. Pat. No. 4,964,182 issued to Joseph Schmerler on Oct. 23, 1990, which shows a transfer aid for elderly or infirm individuals. Included in this invention is a selectively swingable and extendable center frame having a plurality of assist bars for grasping by the user. This support frame, connected to an extended base platform, is for positioning in front of the user and is securable in both a substantially vertical and horizontal position, depending upon the needs of the user.

A second type of supporting mechanism includes a pair of support bars for positioning on opposite sides of the user. Here, the user places one hand on each support bar so each arm is in a substantially vertical position. The user pushes downward on the support bar until he or she is in an upright position. Patents showing this type of supporting mechanism are U.S. Pat. No. 4,922,560 issued to Bernard J. Skibinski on May 8, 1990, U.S. Pat. No. 5,226,439 issued to Henry J. O'Keeffe et al. on Jul. 13, 1993, and French Pat. No. 2 274 274 issued on Jan. 9, 1976.

The Skibinski patent discloses a portable assist having two handles attached to a rectangular platform. These handles are for the user to push upon when elevating himself or herself into a standing position. When the device is not being used, the handles may be rotated into a position where they rest on the platform.

The O'Keefe patent teaches a supporting device for use with a standard chair. A platform supports the chair and includes two vertically adjustable handles extending adjacent to either side of the user. The user pushes upon the handles when moving into an upright position, and the weight of the user and chair prevents the platform from either tipping over or slipping. A similar device is shown in the French patent, which discloses two vertically adjustable handles. This invention, however, does not include a platform to support the user as he or she rises to an upright position. A stabilizing bar is provided as a pedestal for the foot of a caregiver.

Another supporting mechanism, related to and often used in conjunction with the mechanism of the present invention, is the walking aid commonly referred to as a "walker." U.S. Pat. No. 4,640,301 issued Feb. 3, 1987 to Joseph D. Battiston, Sr. et al., U.S. Pat. No. 5,188,139 issued Feb. 23, 1993 to Richard J. Garelick, and U.S. Pat. No. 5,275,187 issued Jan. 4, 1994 to Daniel E. Davis each show different configurations of such walkers. In these patents, the supporting mechanisms disclosed are collapsible, utilizing vertical side supports pivotally attached to front cross bars. Such collapsibility provides added convenience to both the user and caregiver, allowing the walker to be easily transported. To prevent the walker from collapsing during use, each of the configurations shown in these patents employ pin-like members that ensure the side supports are maintained in position during use.

None of the above inventions and patents, taken either singly or in combination, is seen to describe the instant invention as claimed.

SUMMARY OF THE INVENTION

This invention is a transfer aid for assisting people with restricted mobility to rise from a seated position into a standing position. It is a lightweight, portable device having a grasping portion for positioning in front of the user. To rise from a seated position, the user clutches and pulls on this grasping portion until he or she is standing upright.

The grasping portion is secured by two supports, one on each side of the grasping portion. Each of these supports is rotatable with respect to the grasping portion, allowing the transfer aid to be arranged into a plurality of configurations. This adds flexibility to the transfer aid and therefore allows its use to be tailored to the specific needs of each patient and caregiver. If it is necessary to store the transfer aid or to carry it through a narrow passageway, it can be folded into a small and easily manageable configuration. When the transfer aid is utilized, each support can be rotated out of the path of the user when he or she is walking either to or from the grasping portion. This is especially important when the transfer aid is used in conjunction with a walker or similar device, which is difficult to maneuver in confined areas. Wheels attached to the transfer aid allow it to be easily moved. These wheels are arranged on the transfer aid not to contact the floor when the elongated bases of the transfer aid are flat on the floor. However, when the transfer aid is tilted, these wheels engage the floor and allow the device to be easily moved.

Accordingly, it is a principal object of the invention to provide a novel transfer aid of a lightweight, sturdy construction.

It is another object of the invention to provide a novel transfer aid capable of being folded for storage or for carrying through a narrow passageway.

It is a further object of the invention to provide a novel transfer aid capable of being arranged into a plurality of configurations.

Still another object of the invention is to provide a novel transfer aid having wheels facilitating maneuvering of the transfer aid.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 1 is a perspective view of a first embodiment of the transfer aid of the invention.

FIG. 2 is a partial, side, elevational view of a wheel of the transfer aid of FIG. 1, showing the wheel raised above a flooring surface.

FIG. 3 is a partial, side, elevational view of the wheel of FIG. 2 contacting the flooring surface.

FIG. 7 is a perspective view of the transfer aid of FIG. 1, showing a folded position.

FIG. 8A is a top, plan view showing the transfer aid of FIG. 1 in the folded position of FIG. 7.

FIG. 8B is a top, plan view of the transfer aid of FIG. 1, showing an alternate folded configuration.

FIG. 9 is a perspective view of the transfer aid of FIG. 1, showing an open configuration.

FIG. 10 is a top, plan view of the transfer aid of FIG. 1, showing an alternate open configuration.

FIG. 14 is a perspective view of a second embodiment of the transfer aid of the invention.

FIG. 15 is a partial, side, elevational view of a wheel of the transfer aid of FIG. 14, showing the wheel raised above a flooring surface.

FIG. 16 is a partial, side, elevational view of the wheel of FIG. 15 contacting the flooring surface.

FIG. 22 is a perspective view of the transfer aid of FIG. 14, showing an open configuration.

FIG. 23 is a top, plan view of the transfer aid of FIG. 14, showing an alternate open configuration.

Similar reference characters denote corresponding features consistently throughout the attached drawings.

DETAILED DESCRIPTION OF THE PREFERRED EMBODIMENTS

Figure 4:
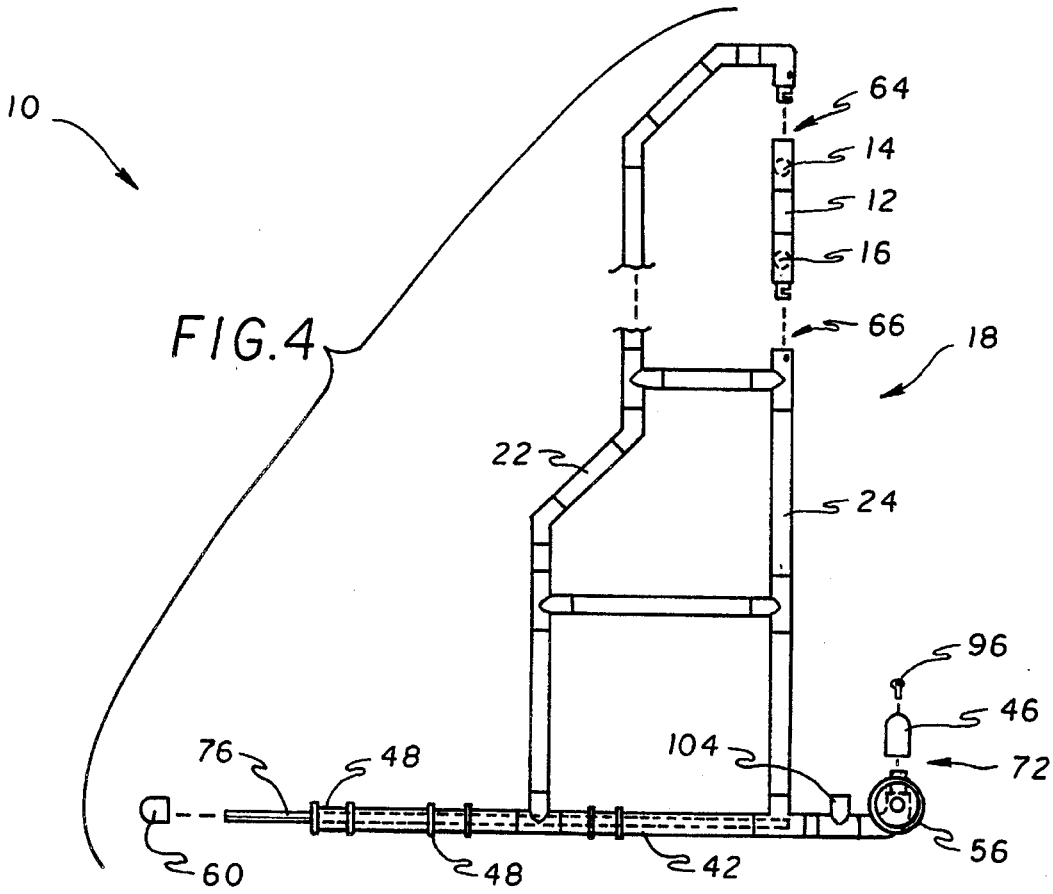
FIG. 4 is a side, elevational view of the transfer aid of FIG. 1.

Referring now to FIG. 1, the present invention is a transfer aid 10 for use by a person having limited mobility when he or she desires to stand from a seated position. This device includes a grasping portion 12 having two shafts 14,16 for the patient to clutch and pull on when rising into a standing position.

These shafts 14,16 are secured by supports 18,20, having sides 22,24 and 26,28, respectively. The distance between sides 22 and 24 is narrower at the top portion 30 of support 18 than it is at the bottom portion 32 of support 18. Correspondingly, the distance between sides 26 and 28 is narrower at the top portion 34 of support 20 than it is at the bottom portion 36 of support 20. The narrow top portions 30,34 allow a caregiver to have uninhibited access to the patient to assist him or her during the standing process. However, the wide bottom portions 32,36 assure stability of each support 18,20. Rods 38,40 secure side 22 to side 24, and rods 41,43 secure side 26 to side 28. These rods 38,40,41 and 43 further increase the stability of transfer aid 10.

Elongated bases 42,44 are attached to supports 18,20, respectively. A portion of each of these elongated bases 42,44 extends forwardly and rearwardly from each support 18,20 to prevent transfer aid 10 from tipping during use. A stabilizing bar 46 connects elongated base 42 to elongated base 44 to increase the stability of the device 10. Each elongated base 42,44 includes rubber belts 48, secured at various points along the length of each elongated bases 42,44, for preventing slippage of transfer aid 10 along the flooring surface 50. Although rubber belts 48 have proven highly effective in eliminating slippage, any other material having a high coefficient of friction could suffice.

Transfer aid 10 may be constructed from PVC schedule 40 plastic tubing and related PVC parts. This plastic is extremely lightweight, thus making device 10 easily transportable from one location to another. To move transfer aid 10, it can be tilted upon the ends of the elongated bases to raise rubber belts 48 away from flooring surface 50. One end 52,54 of each elongated base 42,44 is provided with a wheel 56,58, as shown in FIG. 2. These wheels 56,58 are raised above flooring surface 50 when elongated bases 42,44 firmly rest on flooring surface 50. However, when transfer aid 10 is tilted, as depicted in FIG. 3, wheels 56,58 engage flooring surface 50 and permit rolling of transfer aid 10.

An alternative method of moving transfer aid 10 is to tip it upon the ends of the elongated bases opposite each wheel 56,58. As shown in FIG. 1, these ends are provided with plastic caps 60,62 fabricated from a material having a low coefficient of friction. When transfer aid 10 is tilted so as to rest on these plastic caps 60,62, it is easily pushed to a desired location. This is advantageous, for example, when the ends covered by plastic caps 60,62 are pushed into an area of limited space, such as underneath a bed or a couch.

In addition to being easily movable, transfer aid 10 is maneuverable into a plurality of different configurations. This maneuverability results from a variety of rotatable attachments between several parts of the frame and is best illustrated in FIG. 4. As seen in this figure, grasping portion 12 is rotatably secured to support 18 at locations 64,66. Similar rotatable attachments occur at locations 68,70 which are junction points between grasping portion 12 and top portion 34 (shown in FIG. 1). Additionally, stabilizing bar 46 is rotatably attached to each elongated base 42,44 at locations 72,74. FIG. 4, shows the attachment of stabilizing bar 46 to elongated base 42 at location 72. Also shown in FIG. 4 is rod 76 which fits inside elongated base 42 to increase its strength. A similar rod 76 fits inside elongated base 44 (not shown).

Figure 5:
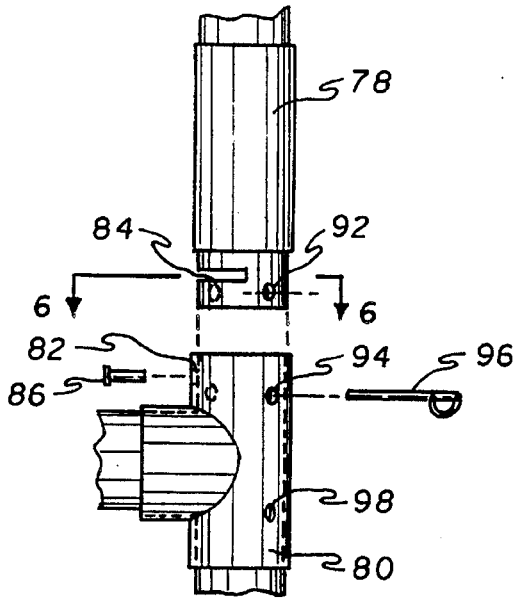
FIG. 5 is a partial, side elevational view of a rotating pipe attachment common to the transfer aid of FIG. 1.
Figure 6:
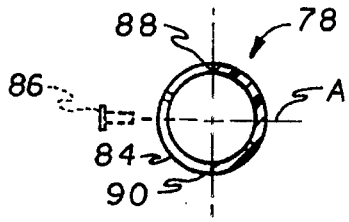
FIG. 6 is a bottom view in cross section of one of the pipes of FIG. 5.

The mechanics of the rotatable attachments at locations 64,66,68,70,72 and 74 are all identical and are depicted generally in FIG. 5. Although this figure depicts an attachment between a straight pipe 78 and a T-shaped pipe 80, this figure is intended to represent the rotatable attachment between any two pipes, regardless of whether one or both of the pipes are straight, T-shaped, or angled. As shown in the figure, pipe 78 fits telescopically into pipe 80 and bore 82 is alignable with slot 84. As seen in FIG. 6, slot 84 extends 180 degrees around the perimeter of pipe 78. Stud 86 protrudes through bore 82 and into slot 84 so as to be at the longitudinal center of slot 84 when transfer aid 10 is in the configuration shown in FIG. 1. This is depicted in FIG. 6, where center line A protrudes through the longitudinal center of slot 84. When pipes 78,80 of FIG. 5 are arranged with stud 86 at the longitudinal center of slot 84, pipe 80 is permitted to rotate relative to pipe 78. This rotation is 90 degrees in either the clockwise direction or the counterclockwise direction when viewed from line 6—6 (FIG. 5). If the rotation is in the clockwise direction, a 90 degree turn of pipe 80 forces stud 86 against point 88 on pipe 78. This contact of stud 86 against point 88 terminates rotation of pipe 80. Correspondingly, after a 90 degree turn in the counterclockwise direction, point 90 impacts stud 86 to terminate rotation of pipe 80.

When transfer aid 10 is in the configuration depicted in FIG. 1, bore 92 in pipe 78 aligns with bore 94 in pipe 80. A pin 96 is inserted into these alignable bores 92,94 to prevent rotation of pipe 80 relative to pipe 78. Pin 96 is easily removed when it is desired to permit the pipes 78,80 to rotate, and pin 96 can be stored in bore 98 when it is not used within alignable bores 92,94. The pins at locations 64,66 (FIG. 4) prevent rotation of support 18 relative to grabbing portion 12, while the pins at locations 68,70 (FIG. 1) prevent rotation of support 20 relative to grabbing portion 12.

As best seen in FIG. 1, transfer aid 10 includes two additional pins 96, one at location 100 and the other at location 102. These locations 100,102 are not points of rotation, but rather are attachment points of stabilizing bar 46 to each elongated base 42,44. These pins respectively protrude into bores within elongated bases 42,44, and into stabilizing bar 46, thereby securely attaching stabilizing bar 46. When the pins 96 at these locations 100,102 are removed, and one of the elongated bases 42 or 44 is slightly rotated away from stabilizing bar 46, the stabilizing bar 46 may be detached from elongated bases 42,44. Opening 104 in elongated base 42 is used to store stabilizing bar 46 after its removal. The importance of removing stabilizing bar 46 will become apparent in the discussion to follow.

It is important to note that each elongated base 42,44 is rotatable with respect to stabilizing bar 46. This rotation occurs at locations 72,74. The pins 96 which secure stabilizing bar 46 to elongated bases 42,44 are not utilized to prevent rotation of stabilizing bar 46 relative to elongated bases 42,44. Rotation at locations 72,74 can only occur when there is a corresponding rotation at locations 64,66,68, and 70. Therefore, when rotation is prevented at locations 64,66,68, and 70, there can be no rotation at points 72,74.

One of the plurality of configurations of transfer aid 10 is depicted in FIGS. 7, 8A, and 8B, and is referred to hereafter as the folded position. This position is beneficial for storing transfer aid 10 or when transporting it through a confined area, such as a doorway. To collapse transfer aid 10 into this folded position, elongated bases 42,44 must be free to rotate relative to stabilizing bar 46. Therefore, as previously mentioned, pins 96 must be removed from locations 64,66,68,70, thus permitting rotation at locations 64,66,68,70,72,74. After the pins 96 have been removed, transfer aid 10 can be placed into its folded position by simultaneously rotating elongated bases 42,44 relative to stabilizing bar 46, as shown in FIGS. 7, 8A and 8B. The folded position of FIGS. 7 and 8A is achieved by rotating elongated bases 42,44 in the counterclockwise direction, when viewed from above. In FIG. 8B, the folded position is achieved by rotating elongated bases 42,44 in the clockwise direction.

Another configuration of transfer aid 10 is shown in FIGS. 9 and 10, and is referred to hereafter as the open position. In order to move transfer aid 10 into this position, stabilizing bar 46 must be removed by withdrawing pins 96 at locations 100,102, and slightly rotating one of the elongated bases 42 or 44, as described above. After removal of stabilizing bar 46, each elongated base 42,44, along with its attached support 18,20, is rotatable with respect to grasping portion 12. Hence, if pins 96 are removed from locations 64,66, support 18 can be rotated, and if pins 96 are removed from locations 68,70, support 20 can be rotated. In the perspective view shown in FIG. 9, pins 96 have been removed from locations 64,66 and support 18 has been rotated from its position depicted in FIG. 1. Stabilizing bar 46, as it attaches to each elongated base 42,44, is shown in phantom lines. It is also shown in solid lines to be stored within opening 104. In FIG. 10, pins 96 have been removed from locations 68,70 and support 20 has been rotated from its position shown in FIG. 1.

That each support 18,20 and its attached elongated base 42,44 can rotate relative to grasping portion 12 adds great flexibility to transfer aid 10. First, the structure allows transfer aid 10 to be used in almost any room, regardless of its size and shape constraints. If a room does not posses sufficient space for elongated bases 42,44 to be arranged in the configuration shown in FIG. 1, each elongated base 42,44 could be angled as necessary to fit within the given constraints. Second, each elongated base 42 or 44 can be rotated away from the path through which the user must walk to either enter or exit from the confines of transfer aid 10. This is extremely valuable to people having limited mobility as even the slightest hinderance can become a substantial obstacle to overcome. Additionally, when transfer aid 10 is used in conjunction with a walker 106, as later described in greater detail, it is important that the user have a clear passageway to and from the machine 10.

In addition to being used in the open position, transfer aid 10, as mentioned, could be utilized when in the configuration depicted in FIG. 1. In fact, it is envisioned that this configuration will be utilized most often and therefore is the topic of the following discussion detailing a typical use of transfer aid 10.

Figure 11:
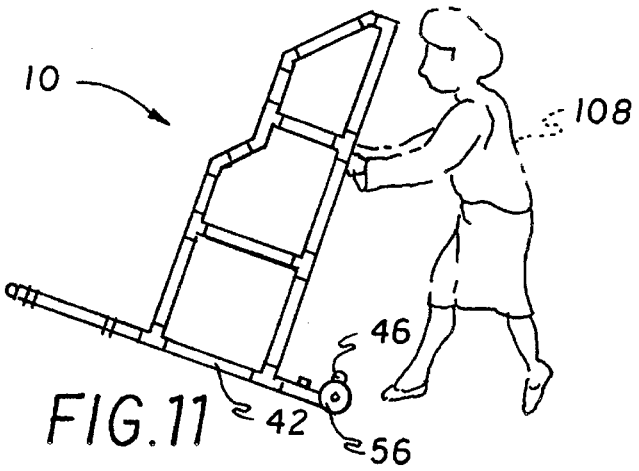
FIG. 11 is an environmental, side, elevational view showing transportation of the transfer aid of FIG. 1.
Figure 12:
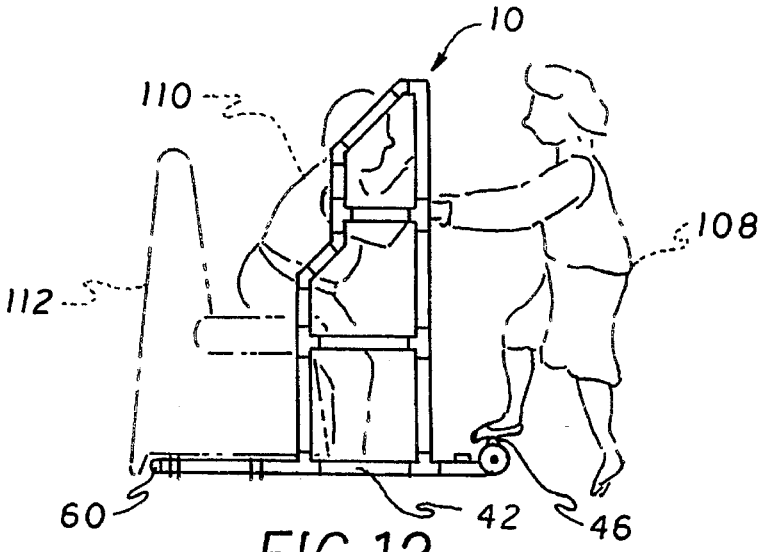
FIG. 12 is an environmental, side, elevational view showing the transfer aid of FIG. 1 in use.

As shown in FIG. 11, a caregiver 108 can easily transport transfer aid 10 upon its wheels 56,58, as described above. The caregiver 108 places the grasping portion 12 in front of a seated patient 110, as illustrated in FIG. 12. If the chair or other apparatus 112 upon which the patient 110 is sitting permits, a portion of each elongated base 42,44 could be secured under the chair 112. Transfer aid 10 can be moved into this position by slightly tipping it to rest upon plastic caps 60,62. Once tipped to this position, a portion of elongated bases 42,44 can be pushed under chair 112, adding stability to transfer aid 10. If, on the other hand, chair 112 is not configured to permit a portion of the elongated bases 42,44 to be placed thereunder, chair 112 could be placed between elongated bases 42,44. Additionally, it is emphasized that transfer aid 10 can be utilized with a stool, bed, recliner, or any other device upon which a person may sit.

When attempting to rise, patient 110 clutches grasping portion 12 and pulls on this portion 12 to lift his or her body into an upright position. As patient 110 pulls on grasping portion 12, caregiver 108 can be in one of two locations. In the first location, caregiver 108 stands with one foot on stabilizing bar 46, as depicted in FIG. 12. This prevents tippage of transfer device 10. The second position of caregiver 108 is slightly to the side of patient 110, where caregiver 108 can physically help patient 110 rise (not shown). When in this position, caregiver 108 can place one foot on the elongated base 42 or 44 directly in front of them. This maintains stability of transfer aid 10. If transfer aid 10 were being used in the open position, where stabilizing bar 46 is removed, this second position is where caregiver 108 would stand.

Figure 13:
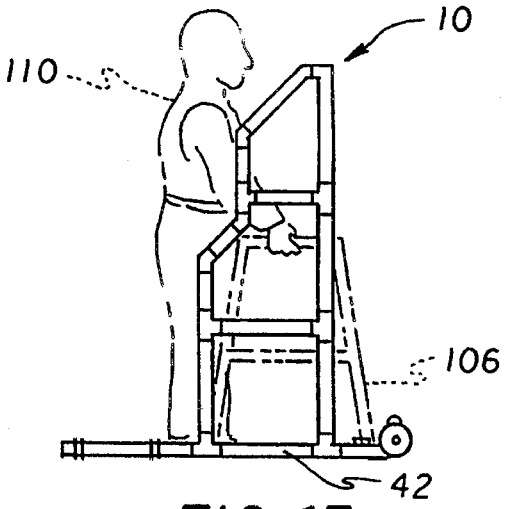
FIG. 13 is an environmental, side, elevational view showing the transfer aid of FIG. 1 used in conjunction with a walker.

Once patient 110 is upright, caregiver 108 can place patient's walker 106, if utilized, directly in front of patient 110, as depicted in FIG. 13. The transition of patient 110 from transfer aid 10 to walking device 106 is smooth and easy as patient 110 need only transfer his or her hands from grasping portion 12 to walker 106. Caregiver 108 can then remove transfer aid 10 from in front of patient 110 by tilting it upon plastic caps 60,62 and sliding it along the flooring surface 50. Alternatively, caregiver 108 can leave transfer aid 10 in front of the patient, and clear a path for patient 110 to walk away from the aid 10. This is accomplished by rotating one of the elongated bases 42 or 44 relative to grasping portion 12, as described above.

The above discussion detailing a common use of transfer aid 10 is only one typical use of transfer aid 10. The flexibility of the device 10, however, allows it to be utilized in a plurality configurations, and therefore transfer aid 10 can satisfy the needs of almost any patient and caregiver. This transfer aid 10 is for use by both the patient and the caregiver and encourages independence as well as a sense of participation.

An alternative embodiment of the invention is illustrated in FIG. 14. Similar to transfer aid 10, the transfer aid 200 of this alternative embodiment includes a grasping portion 212 having two shafts 214,216 for the patient to clutch and pull on when rising into a standing position. Interconnecting these shafts 214,216 is a spacer 217 adding stability to the shafts 214,216.

Securing shafts 214,216 are supports 218,220, which have sides 222,224 and 226,228, respectively. At the locations where sides 222,226 diverge from sides 224,228, there are substantially horizontal sections 237,239, which provide non-slip hand holds usable by a patient having a difficult time reaching grasping portion 212. During clutching of horizontal sections 237,239, the patient can push against transfer aid 200 until achieving a position where he or she can adequately reach grasping portion 214.

Although horizontal sections 237,239 are beneficial to a patient having a difficult time initiating movement out of a chair or similar apparatus, such a configuration may not be desired for a patient capable of directly utilizing grasping portion 212. For this patient, it may be beneficial to eliminate the possibility that he or she can rely on horizontal sections 237,239 to initiate his or her movement. In such a case, transfer aid 200 should be manufactured to include supports similar to those found on transfer aid 10. Similarly, if a patient utilizing transfer aid 10 cannot adequately reach grasping portion 12, supports 18,20 should be manufactured to include either one or more horizontal sections similar to sections 237,239 of transfer aid 200.

Another difference between transfer aid 200 and transfer aid 10 concerns the stabilizing bar. In transfer aid 200, stabilizing bar 246 is rotatably and permanently attached to sides 224,228, which allows stabilizing bar 246 to be usable when transfer aid 200 is arranged in configurations other than that shown in FIG. 14. This stabilizing bar 246 remains in a location where it can be engaged by the foot of a caregiver, allowing the caregiver to provide stability to transfer aid 200. As illustrated in FIGS. 14 through 16, caps 247,249 are utilized to cover the ends 251,253 of the elongated bases 242,244.

A rotation inhibitor 255 connects side 224 to side 228, but it sufficiently spaced from stabilizing bar 246 to permit the passage of a standard walker therebetween. This rotation inhibitor 255 secures transfer aid 200 in the commonly utilized configuration shown in FIG. 14. It is detachable from side 224 to permit each support 218,220 to rotate relative to grasping portion 212, and to allow the passage of an extremely large walker to or from a location proximate grasping portion 212.

Figure 17:
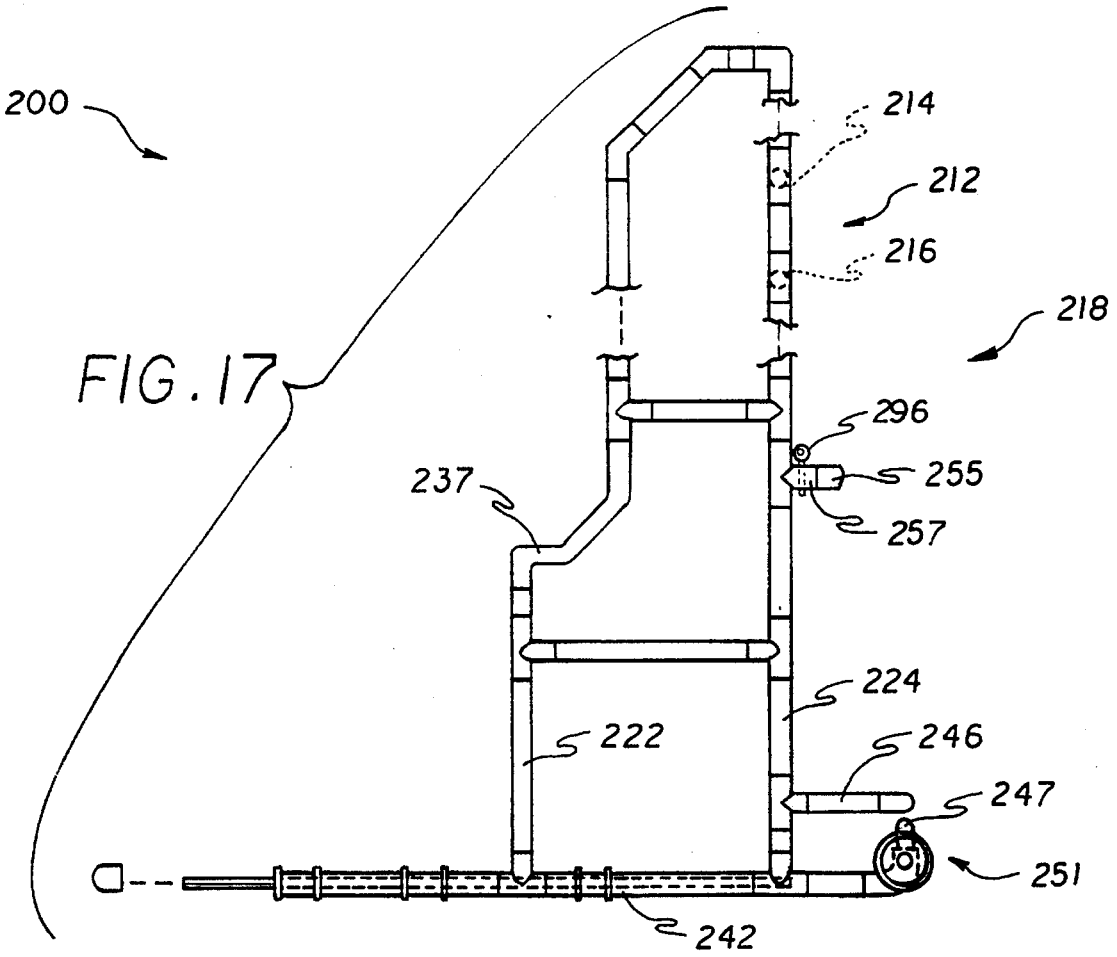
FIG. 17 is a side, elevational view of the transfer aid of FIG. 14.
Figure 18:
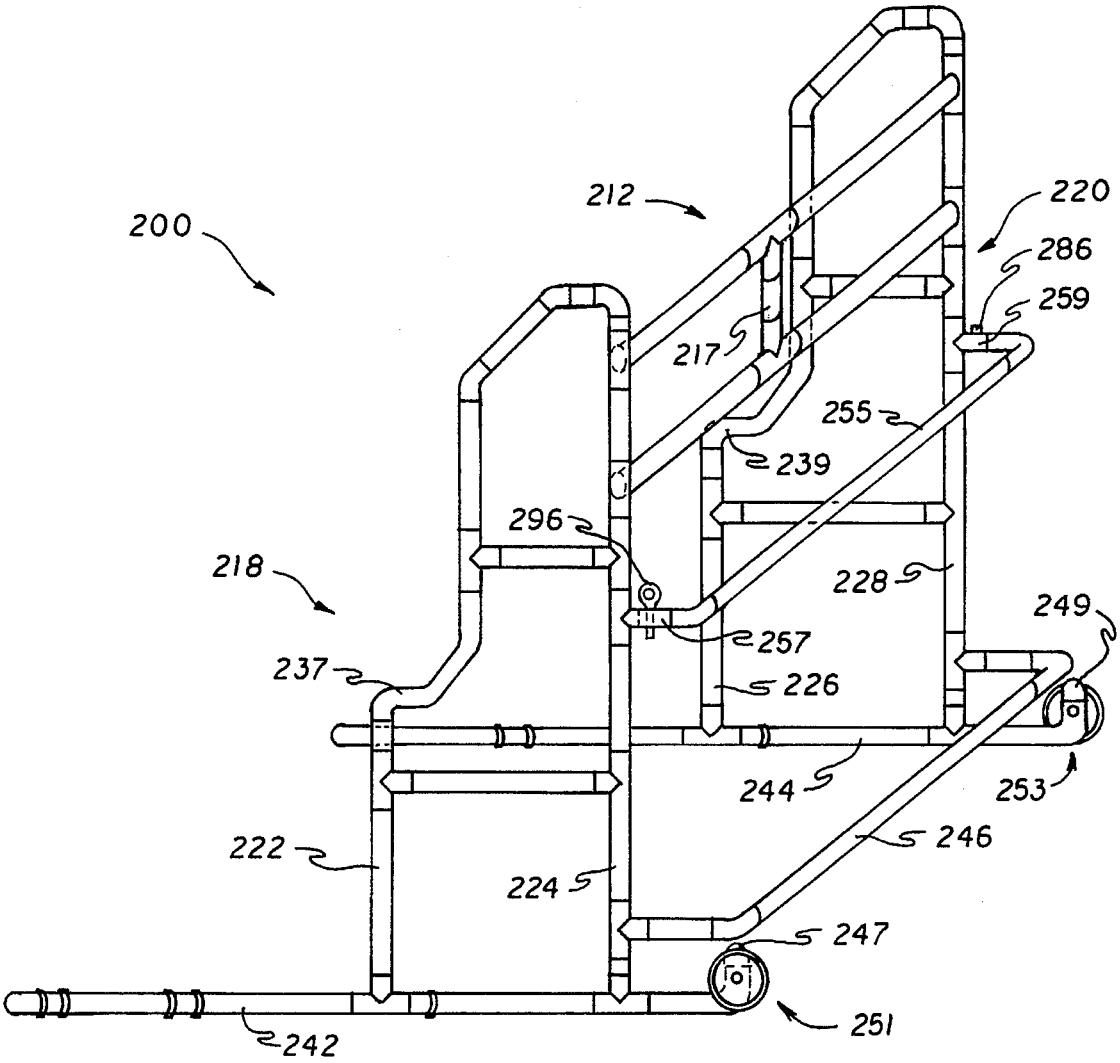
FIG. 18 is a rear, perspective view of the transfer aid of FIG. 14.

As illustrated in FIGS. 17 and 18, a single pin 296 connects rotation inhibitor 255 to a member 257 protruding slightly outward from side 224. The use of a single pin 296 allows for quick and efficient maneuvering of transfer aid 200 into any one of its plurality of configurations. Additionally, minimizing the amount of necessary pins 296, minimizes the likelihood that pin 296 will be inadvertently misplaced.

Figure 19:
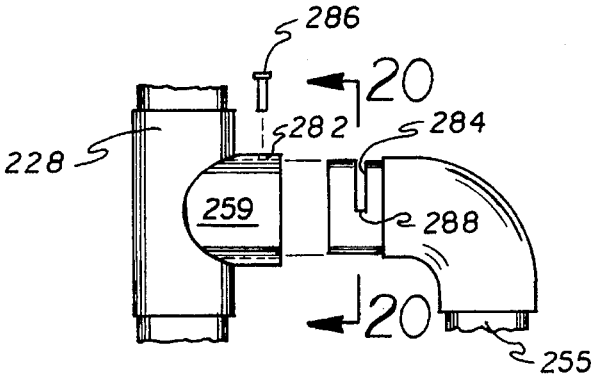
FIG. 19 is a partial, side elevational view of a rotating pipe attachment common to the transfer aid of FIG. 14.
Figure 20:
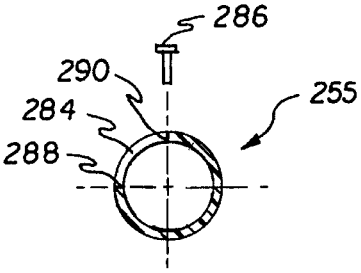
FIG. 20 is a bottom view in cross section of one of the pipes of FIG. 19.

Referring to FIGS. 19 and 20, rotation inhibitor 255 fits telescopically into member 259 secured to side 228. A bore 282 is alignable with a slot 284, which extends 90 degrees around the perimeter of rotation inhibitor 255. A stud 286 protrudes into bore 282 and into slot 284. This stud 286 is at point 288 of slot 84 when rotation inhibitor 255 is connected to member 257. When pin 296 is removed, and rotation inhibitor 255 is detached from member 257, rotation inhibitor 255 pivots relative to member 259, until stud 286 engages point 290, as illustrated in FIG. 6.

Figure 21:
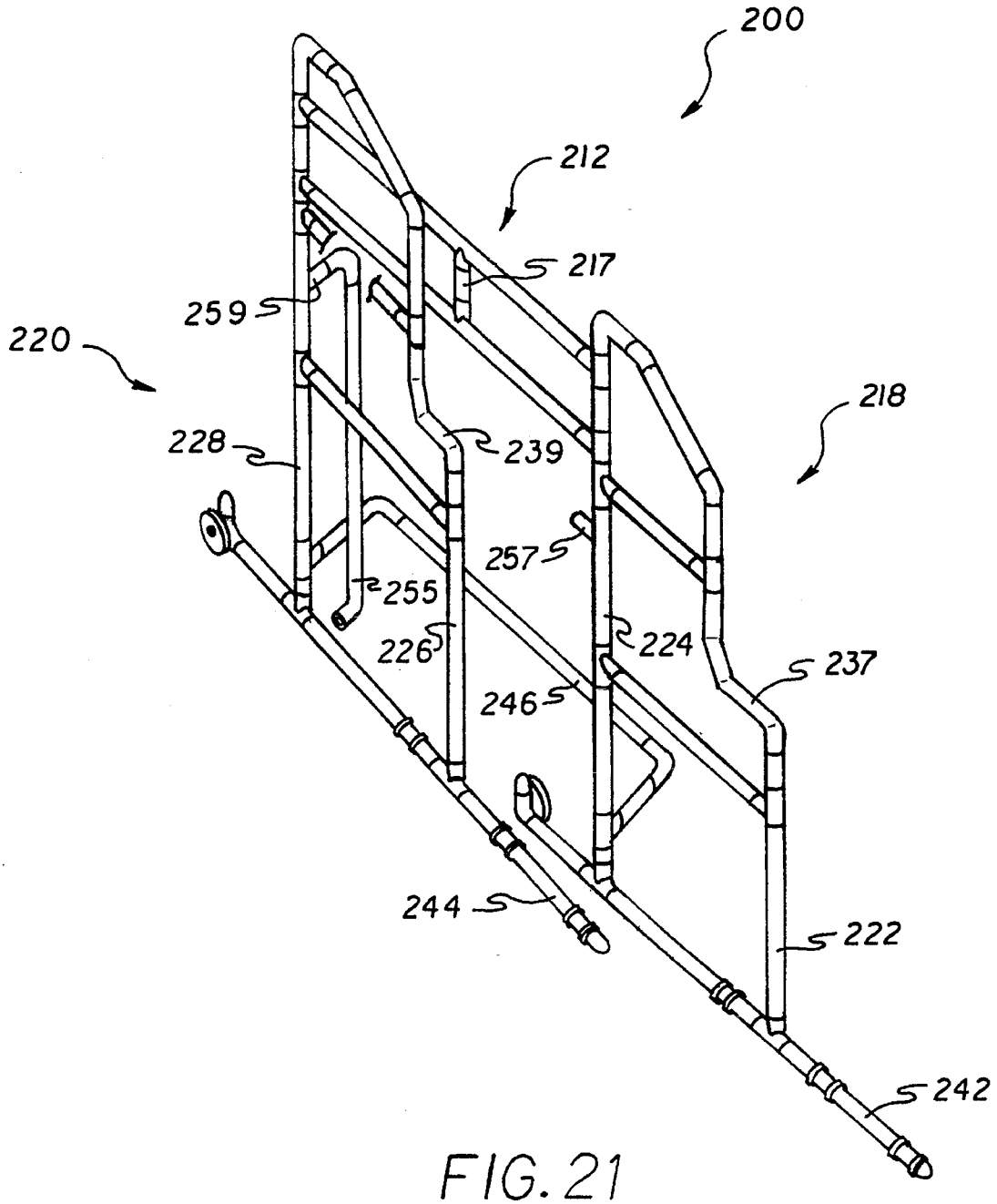
FIG. 21 is a perspective view of the transfer aid of FIG. 14, showing a folded position.

The location of the pivoted rotation inhibitor 255 is shown in FIGS. 21 and 22. In FIG. 21, transfer aid 200 is depicted in a folded position similar to the configuration of transfer aid 10, shown in FIG. 7. This figure illustrates the closed position obtained when supports 212,220 are rotated in a counterclockwise direction when perceived from a top plan view. It is also possible to achieve the closed position by rotating supports 212,220 in a clockwise direction.

In FIG. 22 transfer aid 200 is depicted in an open position, similar to the configuration of transfer aid 10, shown in FIG. 9. This open position has been achieved by rotating support 218. In FIG. 23, an alternative open configuration is achieved by rotating support 220. The amount of rotation of supports 218,220 varies with the needs of the patient and the constraints of the room within which transfer aid 200 is located. It should be noted, however, that after rotation inhibitor 255 has been detached from member 257, supports 218,220 could be rotated either individually or simultaneously. Additionally, it is not necessary that supports 218, 220 be rotated in the same direction.

It is to be understood that the present invention is not limited to the embodiments described above, but encompasses any and all embodiments within the scope of the following claims.

I claim:

1. A transfer aid comprising:

an elongated base;

a pair of supports extending from said elongated base;

a grasping portion having at least one shaft extending between said pair of supports and serving as a hand hold, said grasping portion being pivotable with respect to one of said pair of supports, said base extending forwardly and rearwardly of said pair of supports; and a rotation inhibitor for selectively rigidly interengaging said grasping portion and said pair of supports, said rotation inhibitor extending between said pair of supports, said rotation inhibitor including a break away portion and a hingeable portion spaced from said break away portion.

2. The transfer aid according to claim 1, wherein said grasping portion comprises a pair of generally parallel shafts.

3. The transfer aid according to claim 1, further comprising a stabilizing bar extending between said pair of supports, said stabilizing bar being pivotally connected to each support of said pair of supports.

4. The transfer aid according to claim 1, wherein said elongated base includes an underside for contacting a flooring surface, said elongated base further including at least one wheel rotatably attached thereto, said at least one wheel being out of contact with the flooring surface when said underside is positioned on the flooring surface, said at least one wheel being dimensioned and configured to support said elongated base when said transfer aid is tilted.

5. The transfer aid according to claim 1, wherein said elongated base includes an underside at least partially fabricated from a material having a high coefficient of friction.

6. The transfer aid according to claim 1, wherein said elongated base further includes at least one end including a material having a low coefficient of friction.

7. The transfer aid according to claim 1, wherein said elongated base includes an underside for contacting a flooring surface, said elongated base further including at least one wheel rotatably attached thereto, said at least one wheel being out of contact with the flooring surface when said underside is positioned on the flooring surface, said at least one wheel being dimensioned and configured to support said elongated base when said transfer aid is tilted.

8. The transfer aid according to claim 1, wherein said at least one support further includes a substantially horizontal section.

9. A transfer aid comprising:

an elongated base having an underside for contacting a flooring surface;

a pair of supports extending from said elongated base;

a grasping portion having at least one shaft extending between said pair of supports and serving as a hand hold, said grasping portion being pivotable with respect to said at least one of said pair of supports;

a rotation inhibitor for selectively rigidly interengaging said grasping portion and said at least one of said pair of supports, said rotation inhibitor extending between said pair of supports, said rotation inhibitor including a break away portion and a hingeable portion spaced from said break away portion; and at least one wheel rotatably attached to said elongated base, said at least one wheel being out of contact with the flooring surface when said underside is positioned on the flooring surface, said at least one wheel being dimensioned and configured to support said elongated base when said transfer aid is tilted.

10. The transfer aid according to claim 9, wherein said elongated base extends forwardly and rearwardly of said at least one support.

11. The transfer aid according to claim 9, wherein said grasping portion comprises a pair of generally parallel shafts.

12. The transfer aid according to claim 9, further comprising a stabilizing bar extending between said pair of supports, said stabilizing bar being pivotally connected to each support of said pair of supports.

13. The transfer aid according to claim 9, wherein said underside of said elongated base further includes a material fabricated from a high coefficient of friction.

14. The transfer aid according to claim 9, wherein said elongated base further includes at least one end including a material having a low coefficient of friction.

15. The transfer aid according to claim 9, wherein said at least one support further includes a substantially horizontal section.

* * * * *